US012006583B2

(12) United States Patent
Choi et al.

(10) Patent No.: US 12,006,583 B2
(45) Date of Patent: Jun. 11, 2024

(54) OIL-IMPREGNATED NANOPOROUS OXIDE COATING FOR INHIBITING ALUMINUM CORROSION

(71) Applicant: THE TRUSTEES OF THE STEVENS INSTITUTE OF TECHNOLOGY, Hoboken, NJ (US)

(72) Inventors: Chang-Hwan Choi, Tenafly, NJ (US); Junghoon Lee, Palisades Park, NJ (US)

(73) Assignee: The Trustees of the Stevens Institute of Technology, Hoboken, NJ (US)

( * ) Notice: Subject to any disclaimer, the term of this patent is extended or adjusted under 35 U.S.C. 154(b) by 40 days.

(21) Appl. No.: 17/584,160

(22) Filed: Jan. 25, 2022

(65) Prior Publication Data

US 2022/0178042 A1 Jun. 9, 2022

Related U.S. Application Data

(62) Division of application No. 16/269,348, filed on Feb. 6, 2019, now abandoned.

(60) Provisional application No. 62/627,042, filed on Feb. 6, 2018.

(51) Int. Cl.
*C25D 11/24* (2006.01)
*C25D 11/10* (2006.01)

(52) U.S. Cl.
CPC ..... *C25D 11/246* (2013.01); *C25D 11/24* (2013.01); *C25D 11/10* (2013.01)

(58) Field of Classification Search
None
See application file for complete search history.

(56) References Cited

PUBLICATIONS

Wang et al. "Slippery liquid-infused porous surfaces fabricated on aluminum as a barrier to corrosion induced by sulfate reducing bacteria", Corrosion Science, 93, 2015, 159-166 (Year: 2015).*

Jeong et al. "Single-step direct fabrication of pillar-on-pore hybrid nanostructures in anodizing aluminum for superior superhydrophobic efficiency" ACS Applied Materials & Interfaces, 2012, 4, 842-848 (Year: 2012).*

Jeong et al. "Corrosion resistance of nanoporous superhydrophobic surfaces of anodic aluminum oxide", 2012, Honolulu, HI, The Electrochemical Society. (Year: 2012).*

Lee et al. "Oil-impregnated Nanoporous Oxide Layer of Anodized Stainless Steel for Omniphobic and Anti-corrosive Surfaces", 2016, The Electrochemical Society, ECS Meeting Abstracts, vol. MA2016-02. (Year: 2016).*

(Continued)

*Primary Examiner* — Stefanie S Wittenberg
(74) *Attorney, Agent, or Firm* — Clark Hill PLC; Ralph W. Selitto; John K. Kim

(57) ABSTRACT

A process includes means for depositing an anti-corrosion coating filled with liquid oil on an aluminum substrate. Aluminum is anodized and then treated with a thin hydrophobic sub-coating. The pores created through anodization are then impregnated with liquid oil. Oil penetration is maximized and residual air is minimized by first filling the pores with a filling solution, replacing the filling solution with an exchange fluid, and then replacing the exchange fluid with perfluorinated oil. The oil gives the surface coating anti-wetting properties and self-healing properties, thereby protecting the aluminum substrate underneath from corrosion.

8 Claims, 12 Drawing Sheets

(56) References Cited

PUBLICATIONS

Wang et al., "Slippery liquid-infused porous surface bio-inspired by pitcher plant for marine anti-biofouling application", Colloids and Surfaces B: Biointerfaces 136 (2015) 240-247. (Year: 2015).*
Lee et al., "Oil-impregnated Nanoporous Oxide Layer for Corrosion Protection with Self-Healing", Advanced Functional Materials, 2017, 27, 1606040. (Year: 2017).*

* cited by examiner

OIL-IMPREGNATED NANOPOROUS OXIDE COATING FOR INHIBITING ALUMINUM CORROSION

CROSS-REFERENCE TO RELATED APPLICATIONS

This application is a divisional of U.S. patent application Ser. No. 16/269,348 filed on Feb. 6, 2019, which claims priority to U.S. Provisional Patent Application Ser. No. 62/627,042 filed Feb. 6, 2018, the entire disclosures of both of which are incorporated herein by reference.

STATEMENT REGARDING FEDERALLY SPONSORED RESEARCH

This invention was made with government support under Grant No. N00014-14-1-0502 awarded by the Office of Naval Research (ONR). The government has certain rights in the invention.

FIELD OF THE INVENTION

This invention relates to a surface treatment coating for inhibiting corrosion of aluminum or other metal substrates and a method for preparing same.

BACKGROUND OF THE INVENTION

Because corrosion is one of the most critical drawbacks of aluminum-based metallic material, various techniques have been applied to protect against corrosion. As a surface treatment method of aluminum, anodizing has been extensively employed in the manufacturing industry to improve surface properties and passivate the metallic surface. Anodizing processes form a thin coating of aluminum oxide that is composed of an inner thin compact layer and an outer thick layer with hexagonal columnar cells and cylindrical pores of nanoscale. Unfortunately, the porous layer may still be prone to corrosion, because corrosive media may be easily absorbed in the pores or adsorbed on the wall surface. Therefore, to seal the porous layer, various post-treatment methods have been applied and used.

Conventional sealing methods used in industrial fields include boiling water, steam, dichromate, nickel acetate and cold nickel fluoride sealing. Solid state oxide materials are formed in the pores by those sealing methods, improving corrosion resistance of the aluminum substrate. However, since the anodic aluminum oxide is naturally hydrophilic, corrosive media can still be absorbed in the pores. Recently, the entrapment of air in the pores via hydrophobic coatings on the anodic aluminum oxide surface was also reported to be effective for the prevention of corrosion. However, when entrapped air is exposed to water for a long time, it can be dissolved into the water. The hydrophobic nature of the surface is also vulnerable to physical damage.

SUMMARY OF THE INVENTION

The invention relates to an oil-impregnated nanoporous aluminum oxide coating, which shows enhanced corrosion resistance and durability. In one embodiment, water-repellent and/or anti-corrosive liquid oil is filled partially or completely in nanopores of an anodic aluminum oxide of an aluminum substrate for inhibiting corrosion thereof. Since the pores are filled with water-immiscible oil within the high-aspect-ratio dead-end nanoscale pores, the oil is retained stably within the pores and passivates the pore walls from corrosion. Due to liquidity of the oil, the oil can effectively flow and fill damaged areas, thereby exhibiting a self-healing capability. In one embodiment, the nanopores are filled with oil completely with no air void within the pores. Due to the geometric effects of the pores (e.g., the high-aspect-ratio dead-end nanoscale pores) and the pressure of air initially occupying the pores, typical dip coating or spin coating may not be sufficient to completely fill the pores with oil. Therefore, a novel solvent exchange method is also provided for the complete filling of the pores with oil in accordance with one embodiment.

BRIEF DESCRIPTION OF THE DRAWINGS

For a more complete understanding of the present invention, reference is made to the following detailed description of an embodiment considered in conjunction with the accompanying drawings, which are described briefly below.

FIG. 1B illustrating a solvent exchange method to completely fill nanopores of the anodic oxide with oil; and FIG. 1C illustrating the self-healing mechanism of the oil-impregnated anodic aluminum oxide).

FIG. 2B illustrating Teflon-coated AAO with oil impregnation by immersing in oil for 24 hours; FIG. 2C illustrating Teflon-coated AAO with oil impregnation by immersing in oil for 20 minutes with ultrasonication; and FIG. 2D illustrating Teflon-coated AAO with oil impregnation by a solvent exchange method in accordance with one embodiment of the present invention).

(FIG. 3A: with the simple dipping process; FIG. 3B: with the solvent exchange method by applying water flow for 5 minutes; FIG. 3C: oil-impregnated anodic aluminum oxide with the solvent exchange method by applying water flow for 48 hours; FIG. 3D: water adhesion on the oil-impregnated anodic aluminum oxide with the solvent exchange method before and after dipping in detergent solution).

(FIG. 4A: impedance VD; FIG. 4B: phase on a Bode plot for bare aluminum (Al), anodic aluminum oxide (AAO), Teflon-coated AAO (T-AAO), oil-impregnated AAO (O-AAO), and oil-impregnated Teflon-coated AAO (O-T-AAO); FIG. 4C: equivalent circuit for model fitting; FIG. 4D: resistance and capacitance of the barrier layer for each surface obtained from the model fitting; FIG. 4E: potentiodynamic polarization curves measured in 1 M HCl solution; and FIG. 4F: corrosion current density calculated by Tafel fitting obtained from the potentiodynamic polarization data).

(FIG. 5A: cracks are generated by bending a sample against a cylindrical pipe (diameter 2 cm); FIG. 5B: higher magnification of an SEM image showing the bottom aluminum surface exposed due to the crack by bending of a sample (T-AAO); FIG. 5C: SEM images of cracks generated on the sample (T-AAO) by the bending and flattening; FIG. 5D: potentiodynamic polarization measurement results of the damaged samples (B-T-AAO and B-O-T-AAO), compared to the original samples (T-AAO and O-T-AAO) as well as Al, conducted in 1 M HCl solution; and FIG. 5E: corrosion current density calculated by Tafel fitting obtained from the potentiodynamic polarization data).

FIGS. 6A-6E show sequential images while FIG. 6F shows the surface after 60 seconds when the corrosive liquid droplet was removed by dipping in water. The scale bar in each sub-figure indicates 1 cm.

FIGS. 7A-7E are sequential images and FIG. 7F shows the surface after 60 seconds when the corrosive liquid droplet was removed by dipping in water. Prior to bending for crack, a shear flow of water was applied on the B-O-T-AAO for 5 minutes. The scale bar in each image in 7A-7F indicates 1 cm.

FIGS. 8A-8E are sequential images and FIG. 8F shows the surface after 60 seconds when the corrosive liquid droplet was removed by dipping in water. Prior to bending for crack, a shear flow of water was applied on the B-O-T-AAO for 5 minutes. The scale bar in each image indicates 1 cm.

DETAILED DESCRIPTION OF EXEMPLARY EMBODIMENTS

The following disclosure is presented to provide an illustration of the general principles of the present invention and is not meant to limit, in any way, the inventive concepts contained herein. Moreover, the particular features described in this section can be used in combination with the other described features in each of the multitude of possible permutations and combinations contained herein.

All terms defined herein should be afforded their broadest possible interpretation, including any implied meanings as dictated by a reading of the specification as well as any words that a person having skill in the art and/or a dictionary, treatise, or similar authority would assign thereto.

Further, it should be noted that, as recited herein, the singular forms 'a,' "an," and "the" include the plural referents unless otherwise stated. Additionally, the terms "comprises" and "comprising" when used herein specify that certain features are present in that embodiment, however, this phrase should not be interpreted to preclude the presence of additional steps, operations, features, components, and/or groups thereof.

Figure 1A:
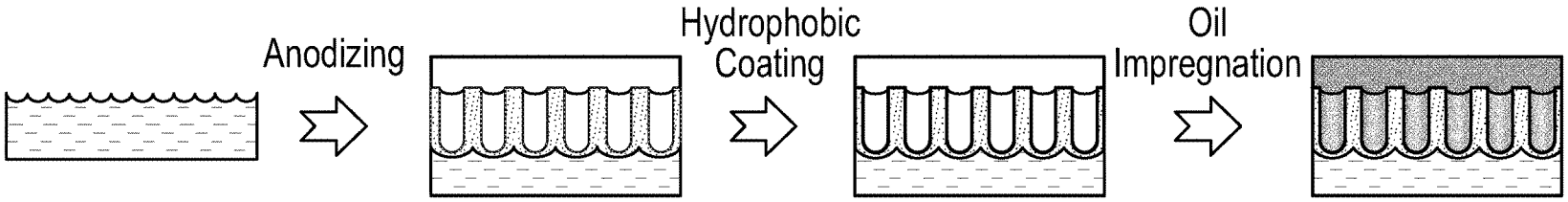
FIGS. 1A-1C are schematic illustrations of a process for preparing and applying an oil-impregnated nanoporous anodic aluminum oxide ("AAO") coating on an aluminum substrate in accordance with one embodiment (FIG. 1A illustrating a preparation procedure based on anodic oxidation of aluminum.

FIG. 1A depicts a process for forming an oil-impregnated nanoporous anodic aluminum oxide coating on an aluminum substrate in accordance with one embodiment of the present invention. Aluminum is first anodized in an oxalic acid to form a nanoporous oxide layer. To make the surface of the nanoporous oxide layer hydrophobic, a thin layer of a hydrophobic coating material, such as the material available under the trademark TEFLON®, is coated on the nanoporous oxide layer surface. The hydrophobized nanopores are then filled with a suitable liquid oil, such as perfluorinated oil (e.g., the oil sold under the trademark KRYTOX® GPL 100).

Figure 1B:
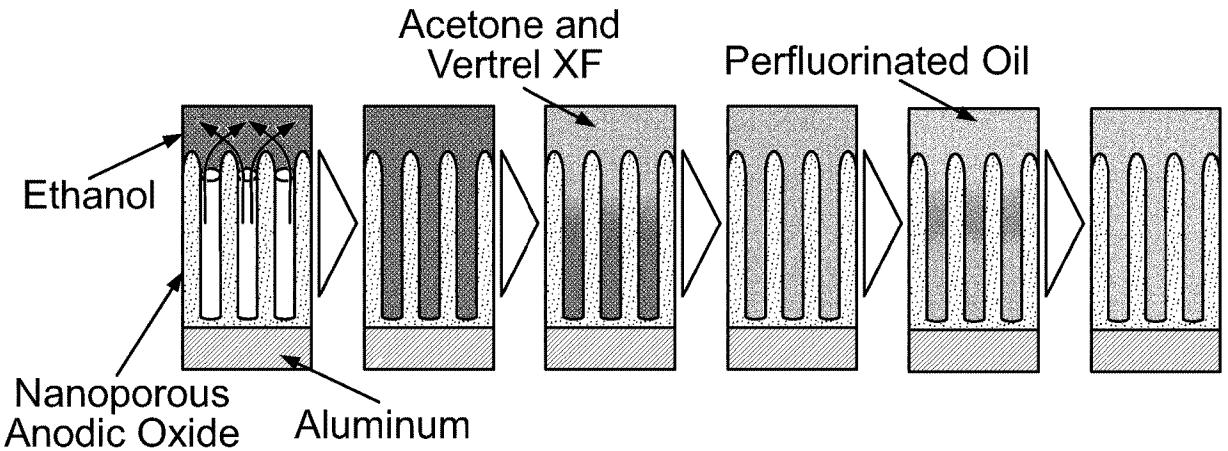
Figure 1C:
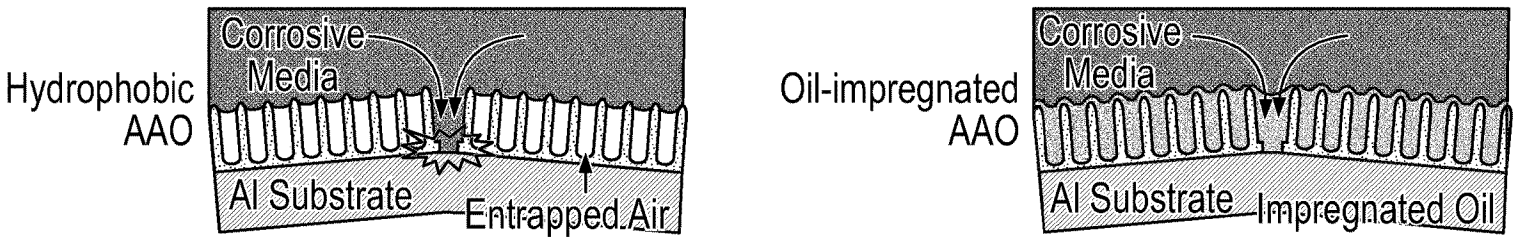

FIG. 1B shows a solvent exchange method used to fill the nanopores of the anodic aluminum oxide layer with perfluorinated oil in accordance with one embodiment. Initially, the nanopores are filled with a filling solution, such as ethanol, which has low surface tension and Henry's constant so that it can easily penetrate the nanopores despite the high-aspect-ratio dead-end nature of the nanopores. Then, the ethanol is replaced with an exchange fluid (such as the fluorocarbon fluid sold under the trademark VERTREL® XF") which is miscible with both ethanol and perfluorinated oil. Finally, the exchange fluid is replaced with perfluorinated oil so that the nanopores contain only the perfluorinated oil. During the solvent exchange process, the surface of the aluminum is not exposed to air, but the replacing steps are done immersed in liquid so that air is not trapped within the pores, resulting in the complete filling with oil. The liquid oil fully impregnated and retained in the nanopores of the anodic oxide layer autonomously flow and fill defective or damaged areas so that it can still protect the metallic aluminum surface from corrosion with improved tolerance, compared to conventional anodic aluminum oxide surfaces where empty pores are readily filled by corrosive media with damages or defects (see FIG. 1C).

To verify the imbibition of the oil in the nanopores of the anodic aluminum oxide ("AAO") layer, a curable photoresist solution is mixed into the exchange fluid (e.g., the VERTREL® XF fluid) (solvent for oil) so that the solution can be solidified and thus be visualized with a scanning electron microscope ("SEM"). FIGS. 2A-2D show SEM images of the cross-sections of the AAO layers after imbibition of the mixture of the VERTREL® XF fluid and the photoresist solution. In the case of the Teflon-coated AAO with no oil impregnation (i.e., air-filled, empty nanopores), the mixture did not penetrate the pores and instead the solidified photoresist material only covered the top surface of the AAO layer (see FIG. 2A).

In the case of the Teflon-coated AAO with oil impregnation achieved by simple dipping in oil for 24 hours (see FIG. 2B), the mixture penetrated the nanopores partially with air still remaining at the bottom of nanopores, indicating that the oil did not fully penetrate into the nanopores. Several air cavities were also observed along the partially filled nanopores, indicating that the nanopores were not continuously filled by the oil.

Figure 2A:
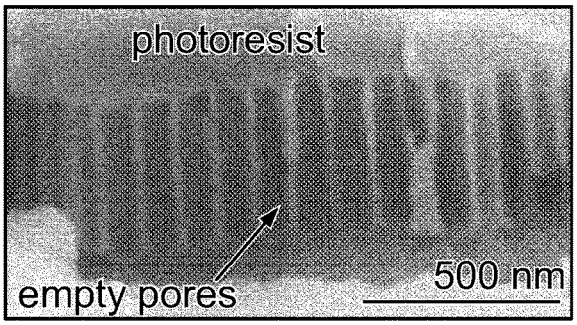
FIGS. 2A-2D are scanning electronic microscope ("SEM") images of cross-sections of AAO layers showing the results of imbibition tests performed using a mixture of an exchange fluid and a photoresist polymer (FIG. 2A illustrating Teflon-coated AAO with empty pores (filled with air)
Figure 2B:
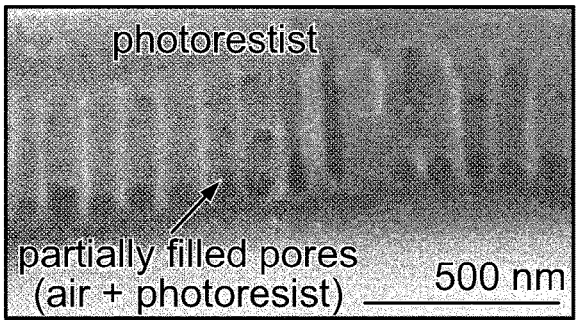
Figure 2C:
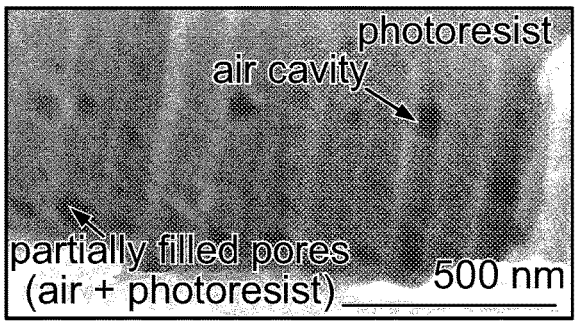
Figure 2D:
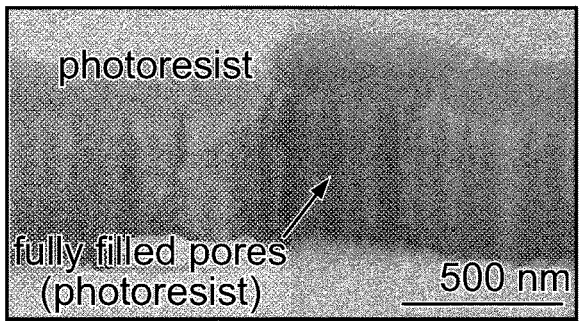

Ultrasonication for 20 minutes was also applied in the simple dipping process to compare with the solvent exchange method. The results illustrated in FIG. 2C show that the ultrasonication helped the mixture to penetrate more into the nanopores. However, air (despite less amount) still remained at the bottom of nanopores, and air cavities were also observed along the nanopores, indicating that the simple dipping may not achieve continuous and full infiltration of the oil into the nanopores.

In the case of the Teflon-coated AAO with oil impregnation by the solvent exchange method described above (see FIG. 2D), the photoresist material completely filled the nanopores and no air pockets were observed at the bottom of the nanopores. The testing results indicate that the oil completely filled the nanopores via the solvent exchange method.

Figure 3A:
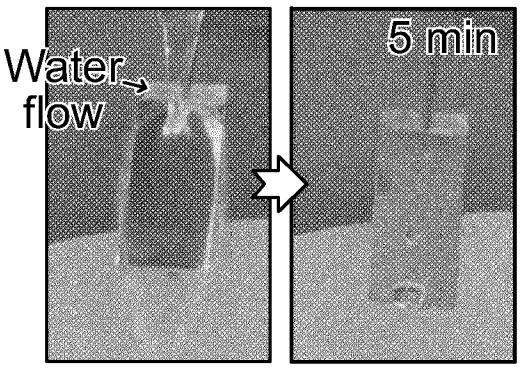
FIGS. 3A-3D show the results of durability tests performed on oil-impregnated anodic aluminum oxides
Figure 3C:
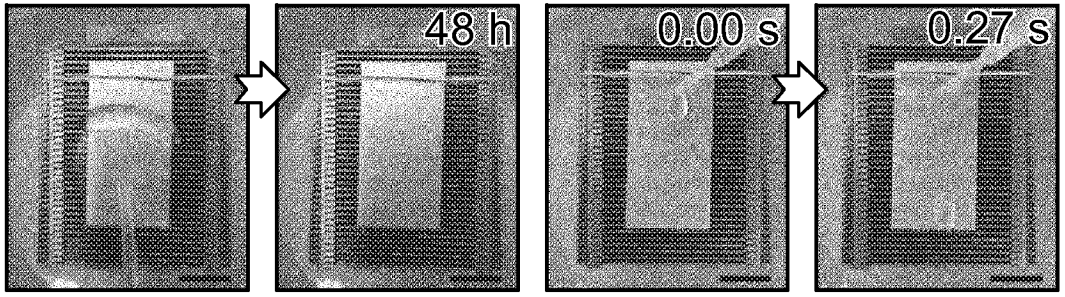
Figure 3B:
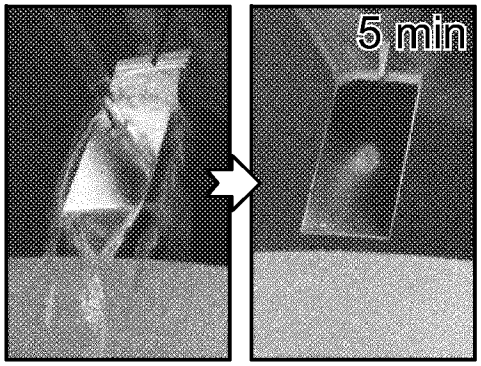
Figure 3D:
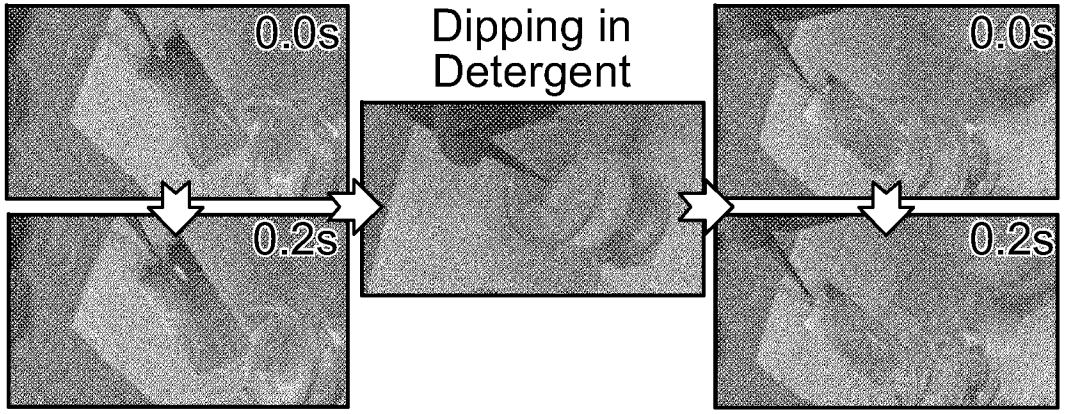

The oil-impregnated AAO prepared without using the solvent exchange method but using a simple dipping for tens of minutes showed significant wetting of water droplets (pinning even at vertical) (90°) inclination in a couple of minutes by the shear flow of water (see FIG. 3A). In contrast, the complete impregnation of oil in the isolated nanoscale dead-end pores allows the penetration of external shear flow by only on the order of the pore width, which is only a fraction of the total pore depth. This feature and completely impregnated oil provide an excellent stability of the lubricant oil fully impregnated within the isolated high-aspect-ratio dead-end nanopore structures so that the slipperiness (roll-off angle: ~3°) can be maintained even against an external shear flow of water (see FIGS. 3B and 3C). In addition, the immiscibility of the perfluorinated oil (i.e., KRYTOX® GPL 100) with other liquids enables the surface to sustain a non-wetting property even against surfactants in water (see FIG. 3D). The stable oil layer completely impregnated in the high-aspect-ratio dead-end nanopores not only allow the surface to be slippery, but also can serve as a robust barrier that prevents the direct contact of the corrosive aqueous media with the aluminum metal underneath.

Figure 4A:
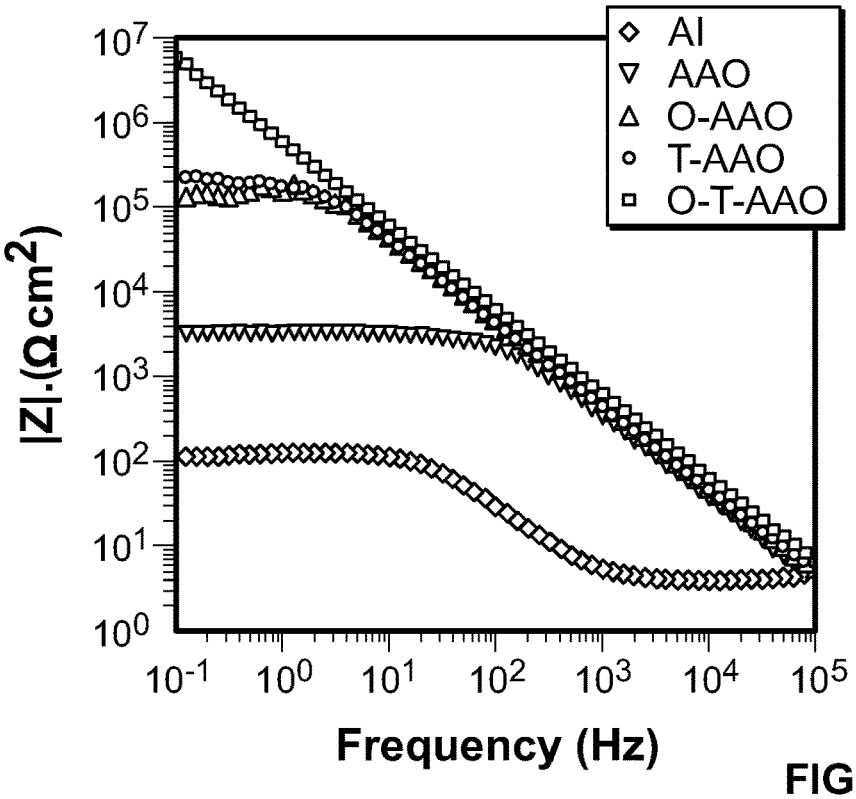
FIGS. 4A-4F illustrate electrochemical impedance spectroscopy (EIS) measured in 1 M HCl solution
Figure 4B:
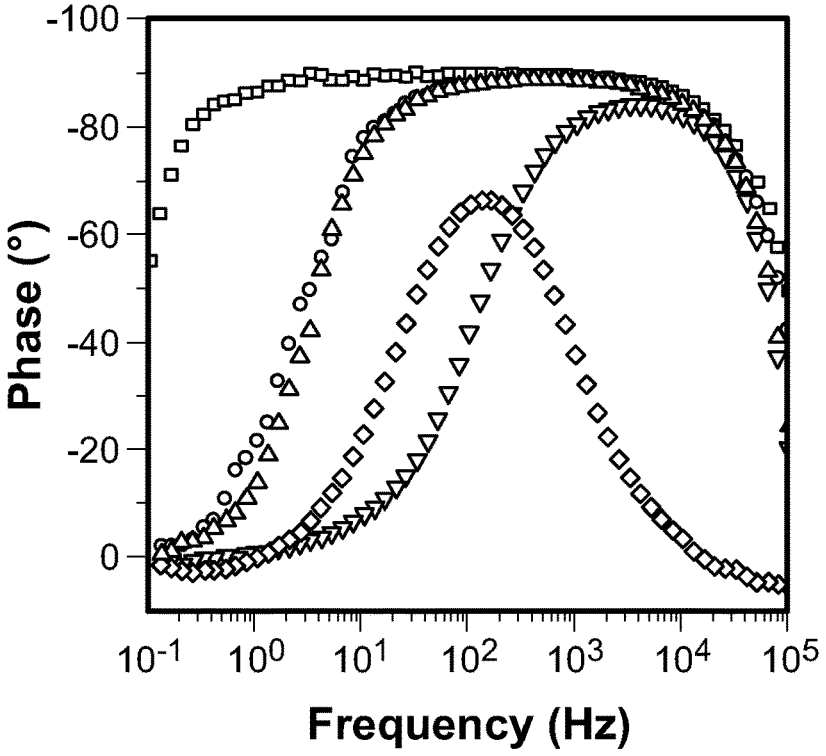
Figure 4C:
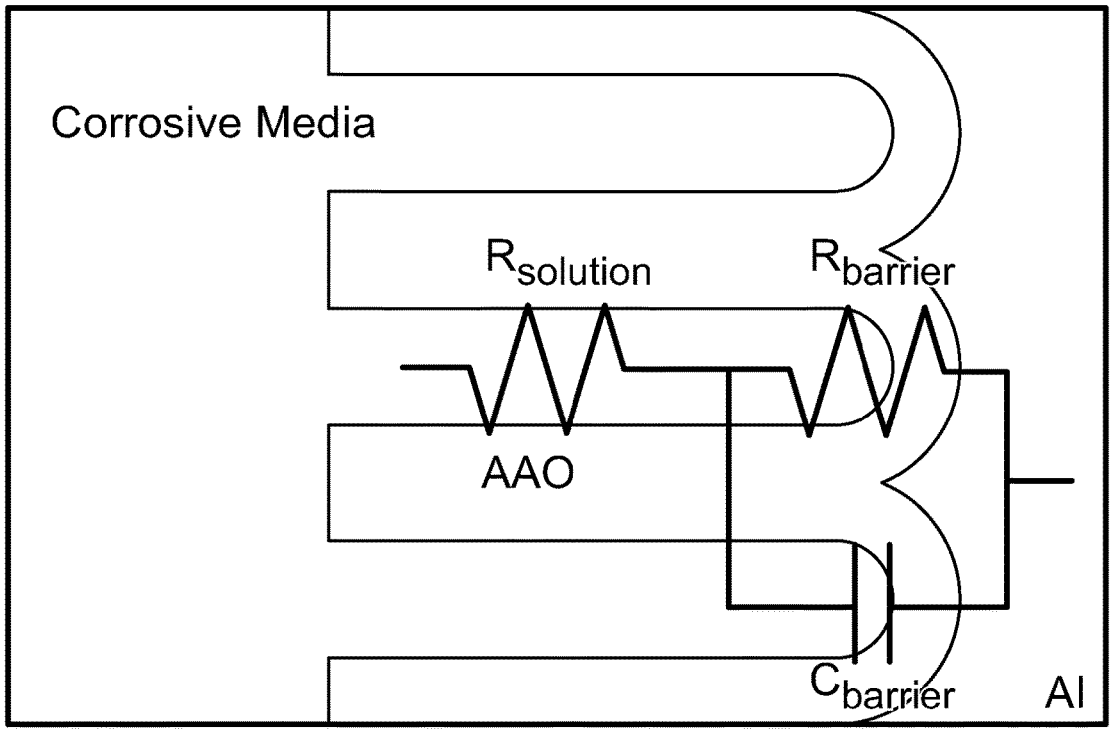
Figure 4D:
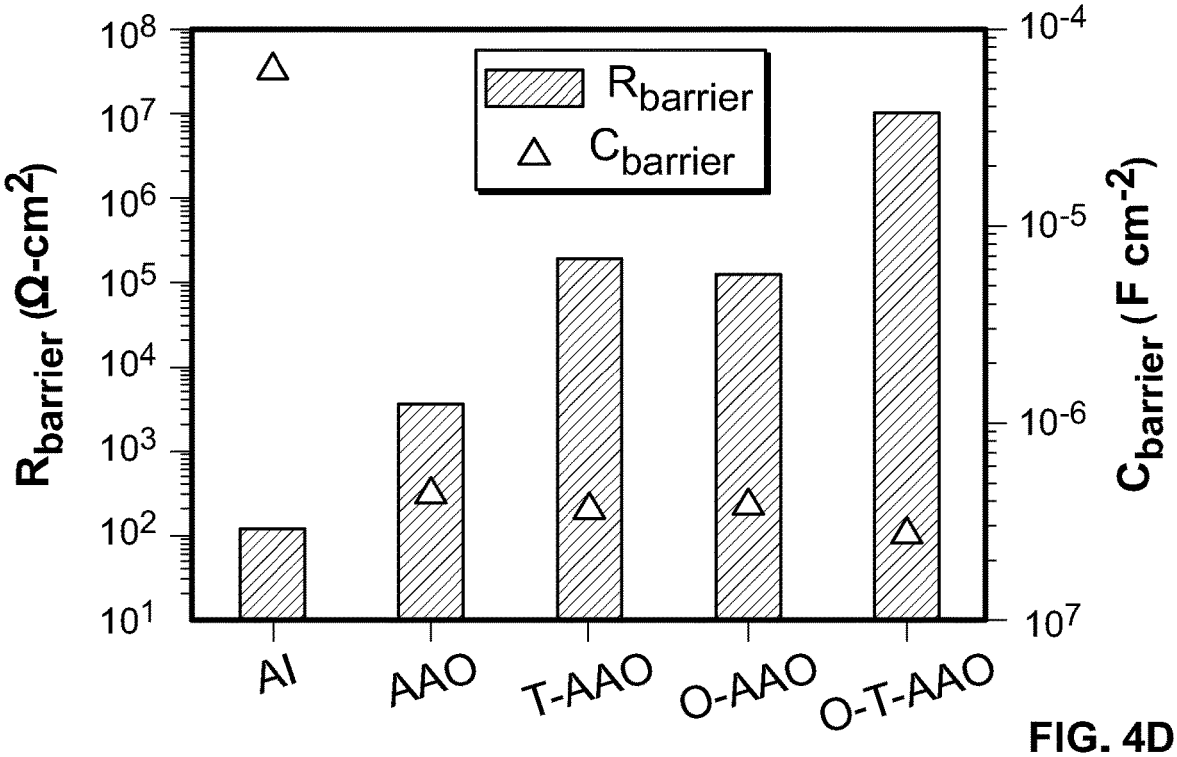

The anti-corrosion performance of the oil-impregnated Teflon-coated AAO (O-T-AAO) surface was evaluated using electrochemical impedance spectroscopy (EIS), compared with aluminum substrate (Al), AAO (inherently hydrophilic), Teflon-coated AAO (T-AAO), and oil-impregnated AAO (O-AAO) surfaces. FIGS. 4A and 4B first show the impedance (|Z|) and phase) (°) on a Bode plot, respectively, obtained using a simplified equivalent circuit as shown in FIG. 4C. With model fitting, $R_{barrier}$ (resistance of a barrier layer) and $C_{barrier}$ (capacitance of a barrier layer) of the surfaces are plotted as shown in FIG. 4D. A higher value of $R_{barrier}$ implies higher corrosion resistance to the corrosive media (1 M HCl solution). In the case of O-T-AAO, the $R_{barrier}$ value was significantly increased, up to $1.03\times10^{7}$ $\Omega\cdot cm^{2}$, which is two orders of magnitude higher than that of T-AAO or O-AAO, and four orders of magnitude greater than that of the bare AAO. The corrosive media is fully separated from the AAO surface by the oil layer (O) which is more stably retained on the surface than in the case of O-AAO, due to the hydrophobic Teflon layer (T) pre-applied on the AAO surface. The results indicate that the hydrophobic Teflon coating facilitates good and stable oil impregnation into the pore structures of the AAO layer. Also, the result indicates that the oil layer impregnated in the case of the O-T-AAO surface is more effective than the air layer impregnated in the case of T-AAO for corrosion inhibition.

Figure 4E:
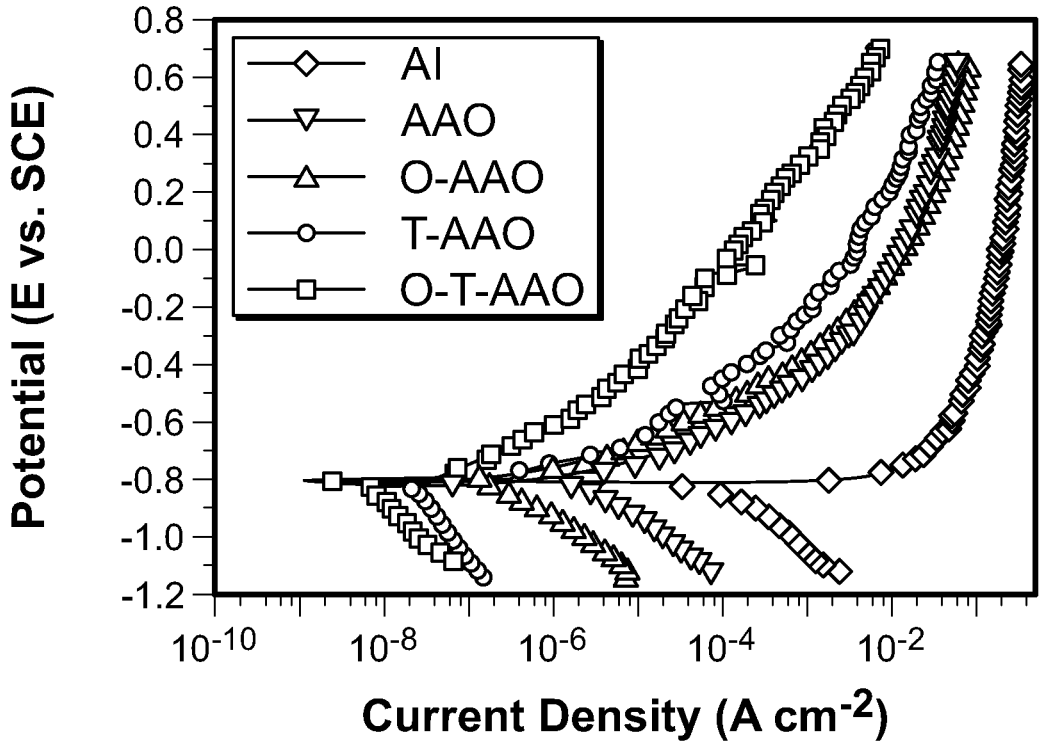
Figure 4F:
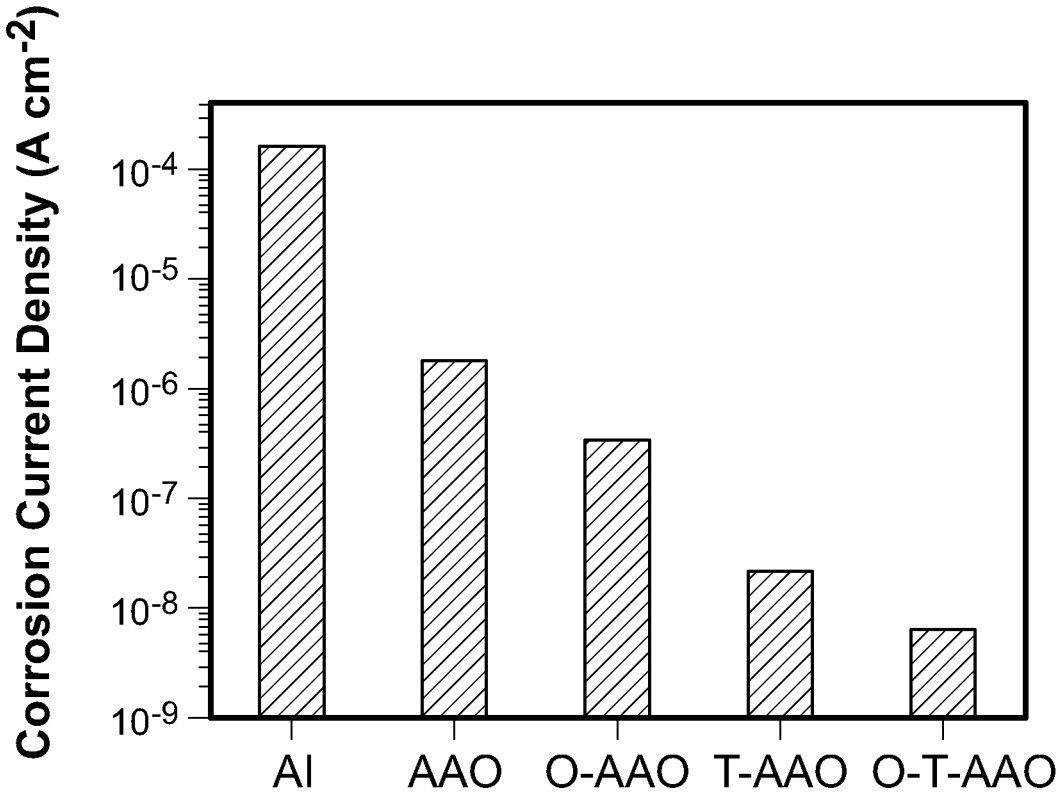

Anti-corrosion performance of the O-T-AAO surface was further evaluated using a potentiodynamic polarization method. FIG. 4E shows the potentiodynamic polarization curves obtained in 1 M HCl solution, while FIG. 4F shows the corrosion current densities calculated by Tafel fitting of the obtained curves. The O-T-AAO shows the lowest value of corrosion current density, up to $6.25\times10^{-9}$ A $cm^{-2}$, which is 3.5 times lower than T-AAO ($2.21\times10^{-8}$ A $cm^{-2}$), and three orders of magnitude lower than bare AAO ($1.89\times10^{-6}$ A $cm^{-2}$). In addition, the O-T-AAO shows the highest IE value, up to 99.99%, which implies excellent corrosion resistance, which is attributed to the superior water repellency resulting from the stable oil layer impregnated into the hydrophobic (i.e., Teflon-coated) nanopores. These results are in line with the EIS results where the highest $R_{barrier}$ value was measured for O-T-AAO, and indicate that the oil impregnated nanopores are more effective in inhibiting corrosion than the air impregnated hydrophobic surface (T-AAO).

Figure 5A:
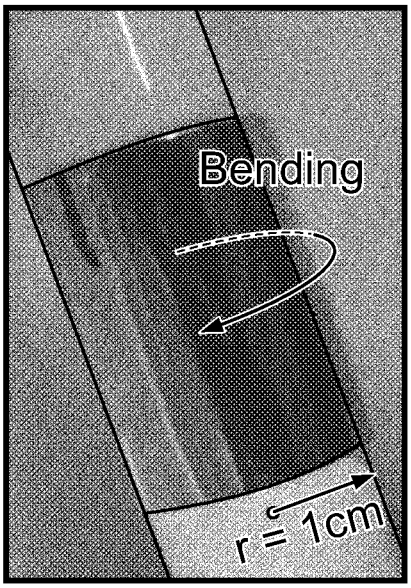
FIGS. 5A-5E illustrate crack generation in the AAO layer and the evaluation of corrosion tolerance to the surface damage
Figure 5B:
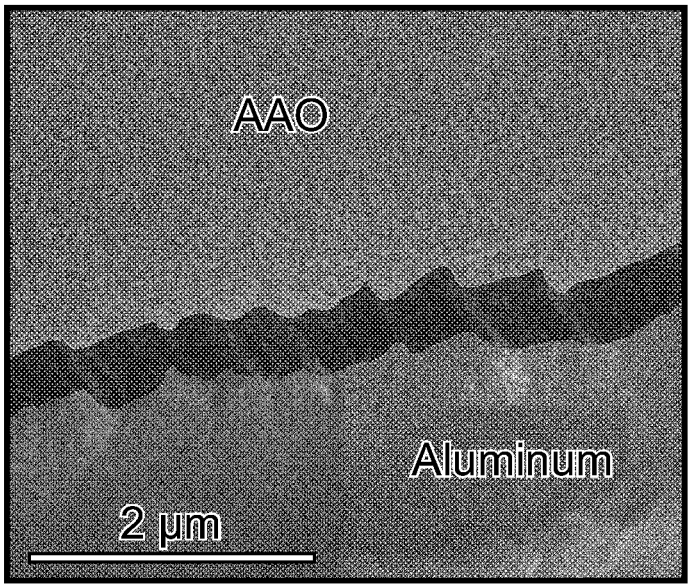
Figure 5C:
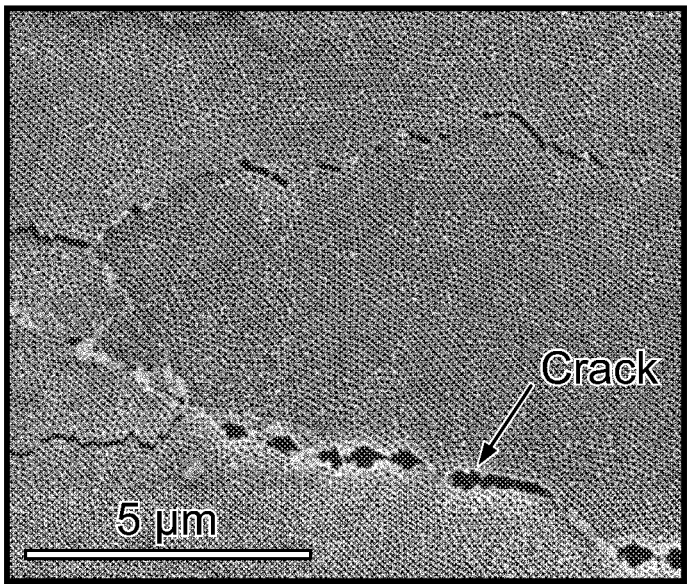
Figure 5D:
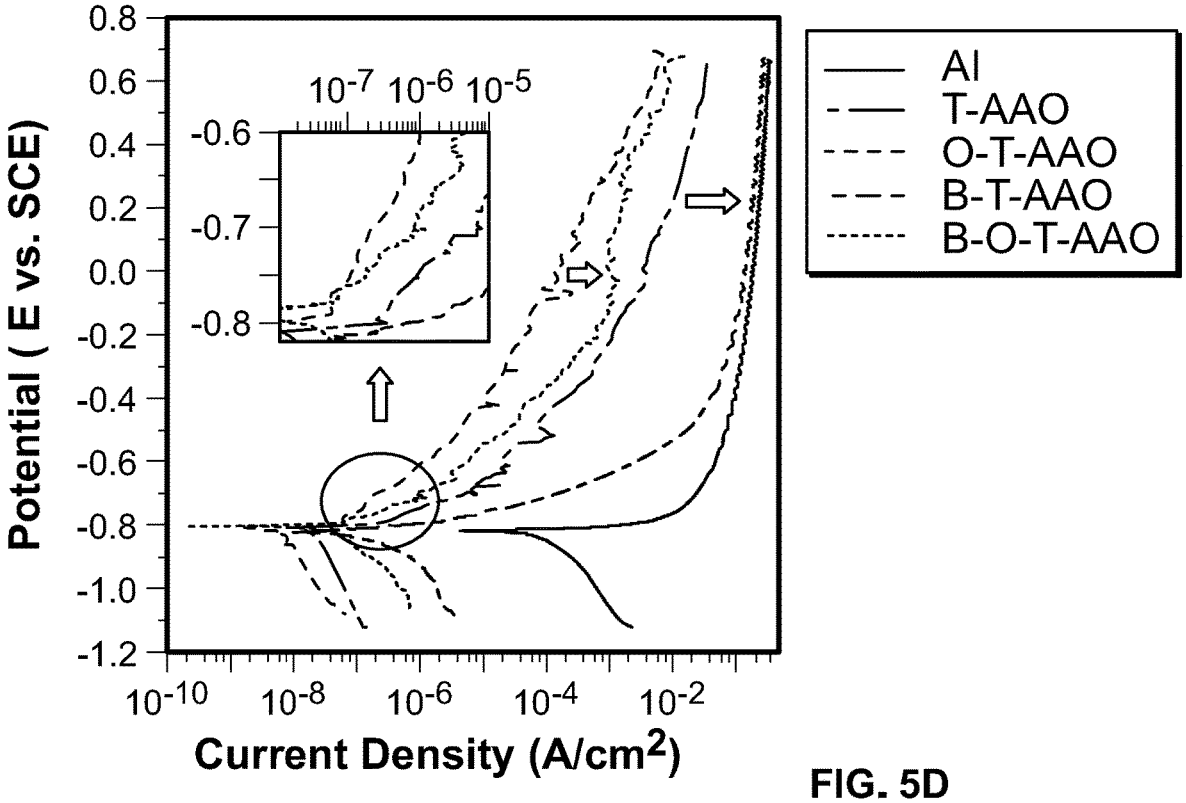
Figure 5E:
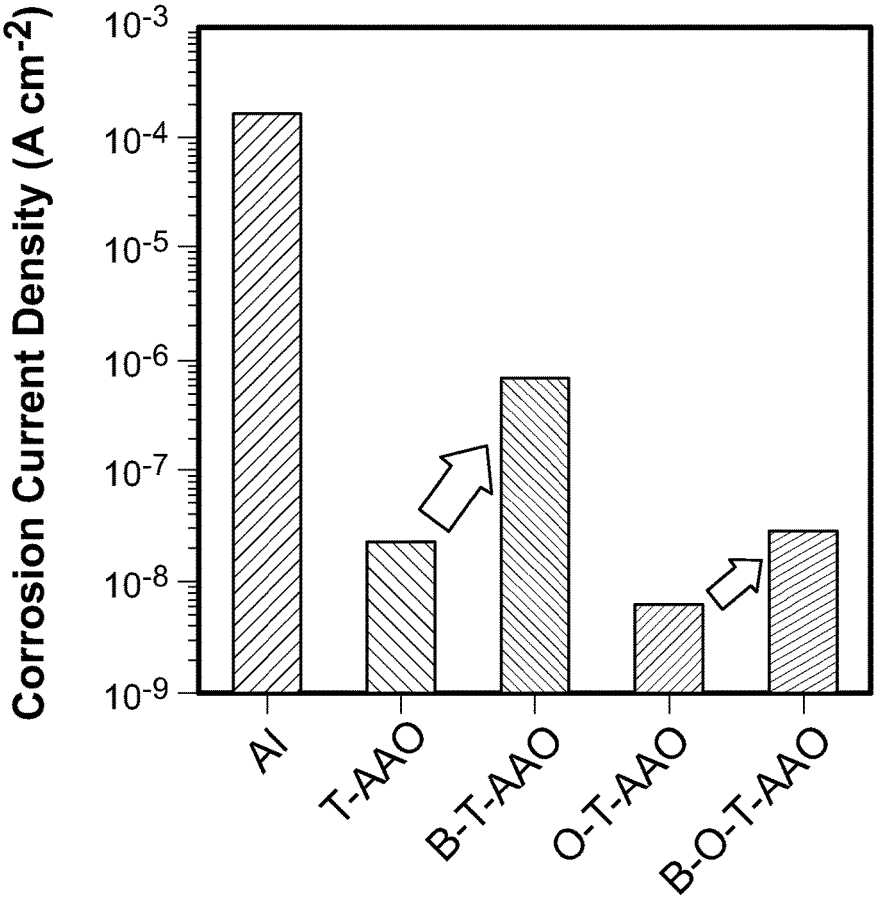
Figure 6A:
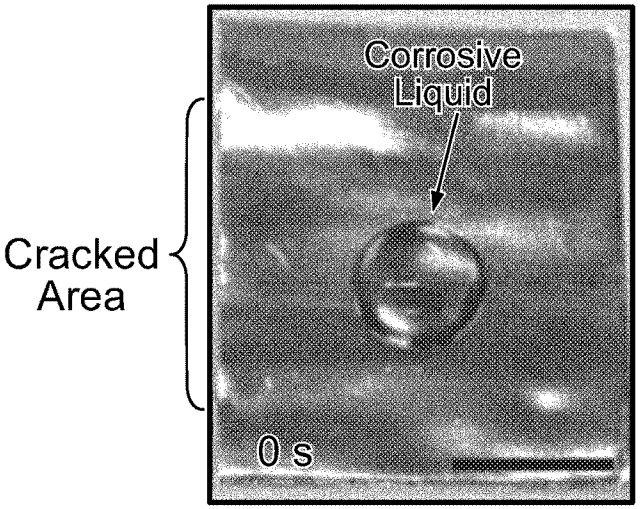
FIGS. 6A-6F illustrate sequential images of a highly corrosive liquid droplet (35 wt. % HCl+saturated $CuSO_4$) sitting on the surface of B-T-AAO.
Figure 6B:
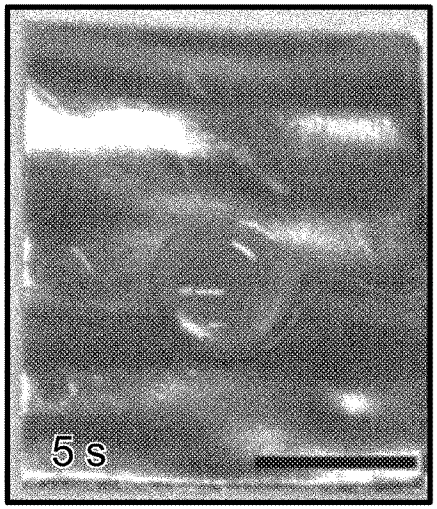
Figure 6C:
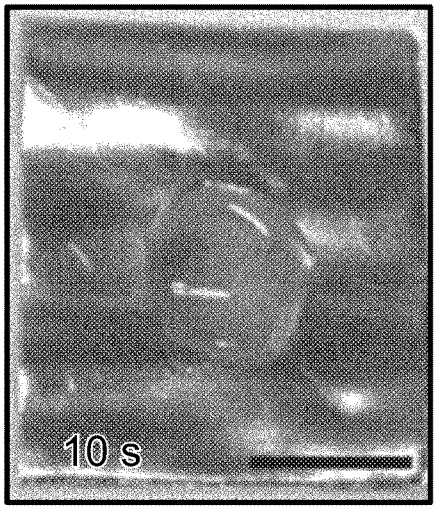
Figure 6D:
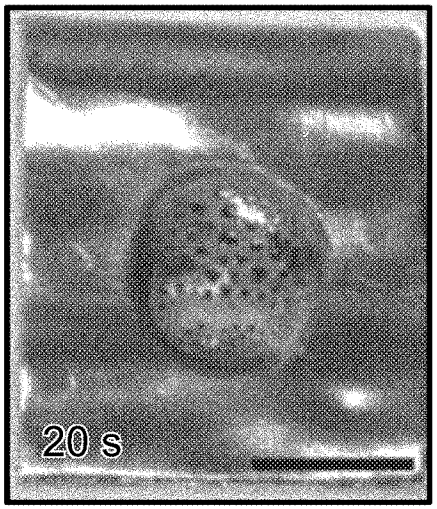
Figure 6E:
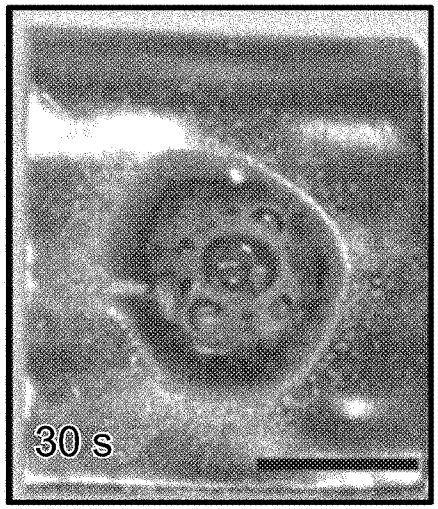
Figure 6F:
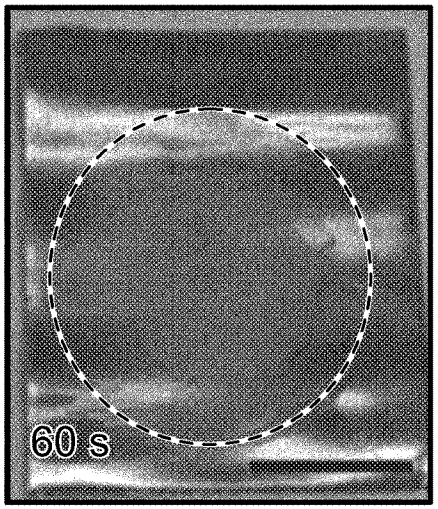
Figure 7A:
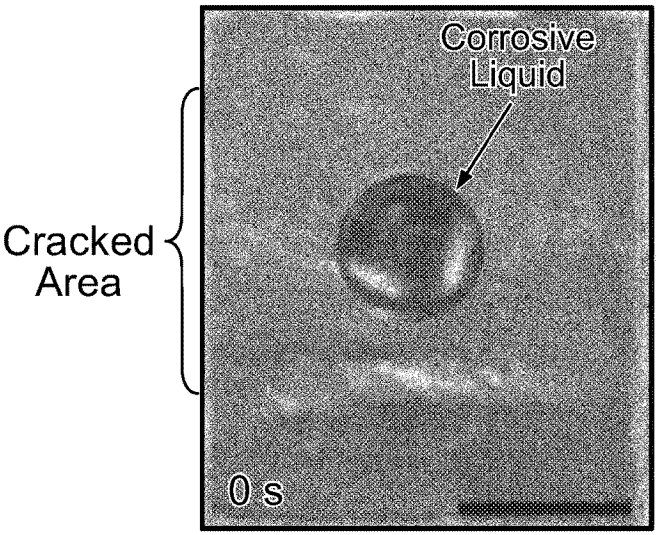
FIGS. 7A-7F illustrate sequential images of a highly corrosive liquid droplet (35 wt. % HCl+saturated $CuSO_4$) sitting on the surface of B-O-T-AAO prepared with a conventional dip coating method.
Figure 7B:
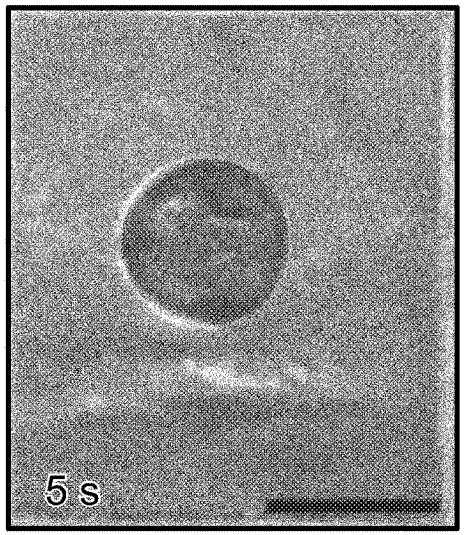
Figure 7C:
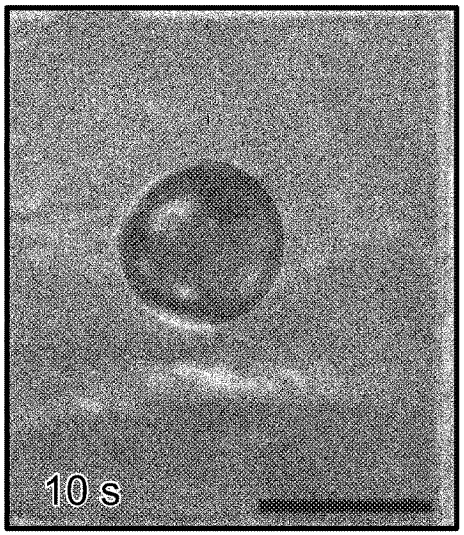
Figure 7D:
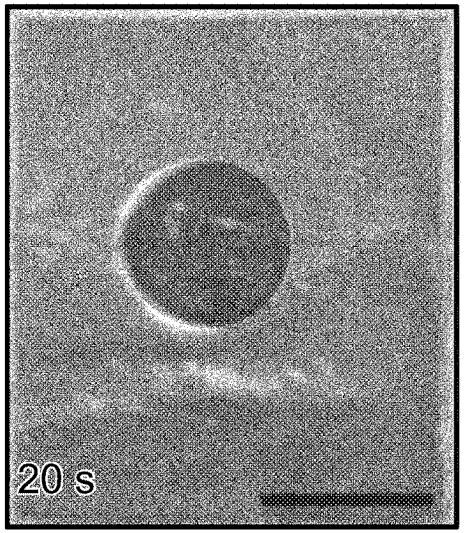
Figure 7E:
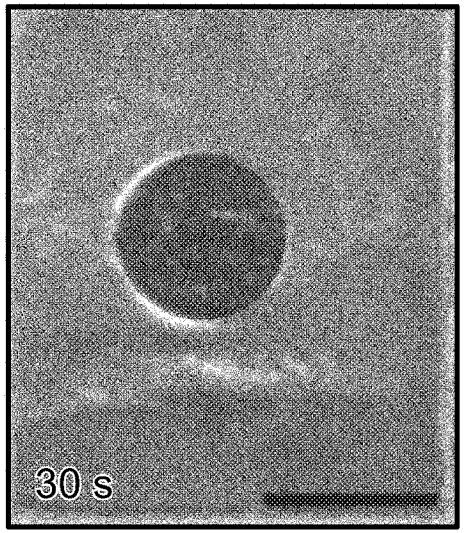
Figure 7F:
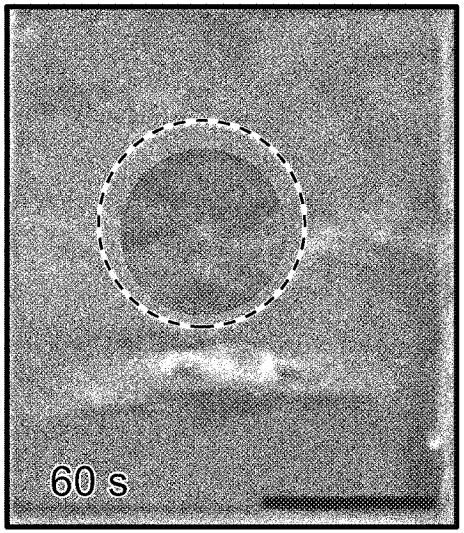
Figure 8A:
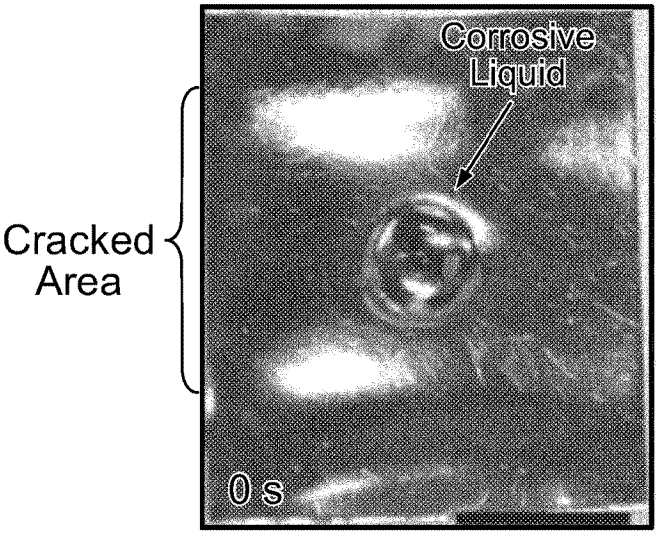
FIGS. 8A-8F illustrate sequential images of a highly corrosive liquid droplet (35 wt. % HCl+saturated $CuSO_4$) sitting on the surface of B-O-T-AAO prepared with the solvent exchange method.
Figure 8B:
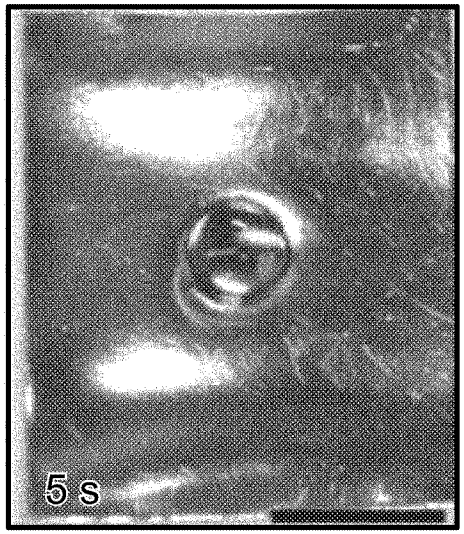
Figure 8C:
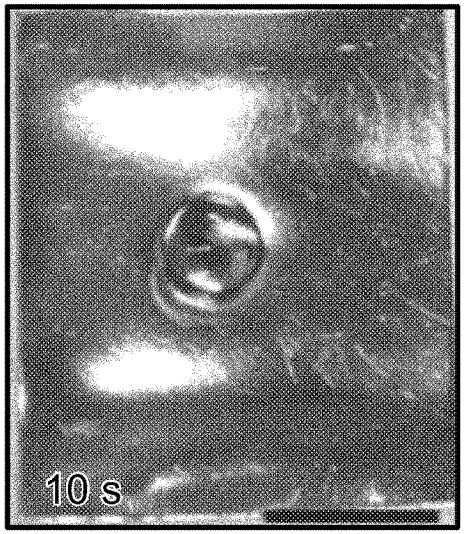
Figure 8D:
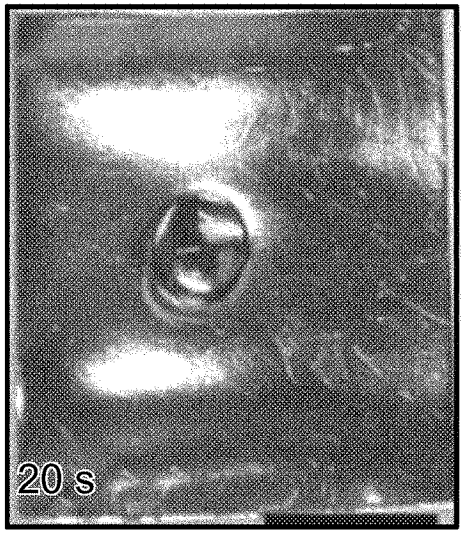
Figure 8E:
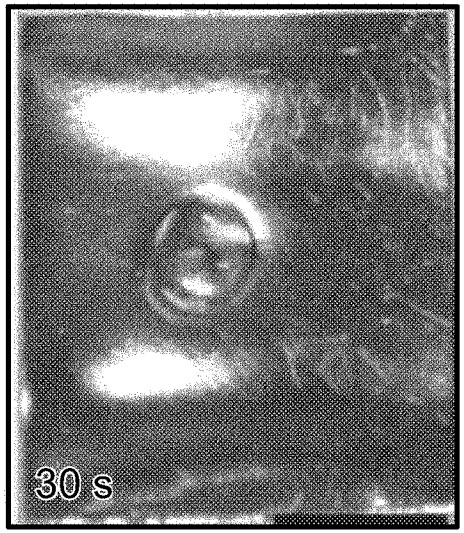
Figure 8F:
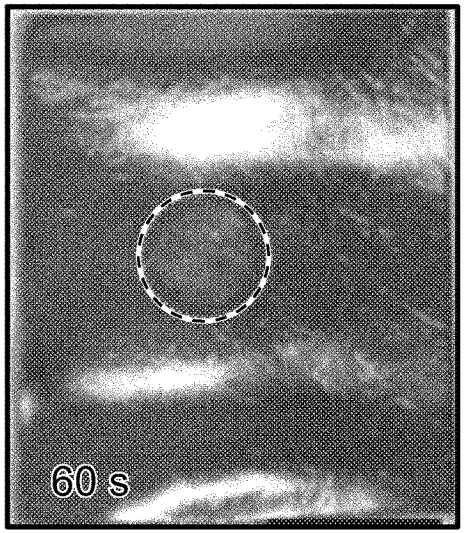

Surface damage of a coating layer is regarded as a potential issue for anti-corrosive surface treatments, including anodization, since the metal surfaces are likely to be exposed after being damaged. In one embodiment, the oil-impregnated surface of the present invention may autonomously recover damaged surface areas by allowing the impregnated liquid oil to immediately flow and cover the exposed areas upon damage. To evaluate the corrosion tolerance to such surface damage, cracks were deliberately created in the AAO layer by bending the AAO samples (T-AAO and O-T-AAO) against a cylindrical tube (diameter 2 cm), as shown in FIG. 5A. The cracks in the AAO layer caused the underlying aluminum substrate to be exposed to the external environment (see FIG. 5B). After the cracks were generated, where most of the cracks are formed perpendicular to the bending direction, the samples were flattened back. As shown in FIG. 5C, the cracks were still evident even after being flattened back, causing the underlying aluminum substrate to be exposed to the corrosive media. The corrosion resistance of the bent T-AAO and O-T-AAO samples (named B-T-AAO and B-O-T-AAO, respectively) was evaluated by potentiodynamic polarization measurements in 1 M HCl solution. The results of the potentiodynamic polarization measurement and the corrosion current densities for B-T-AAO and B-O-T-AAO, compared with T-AAO and O-T-AAO, as well as bare Al, are shown in FIGS. 5D and 5E, respectively. After the cracks were generated on the AAO layers, the corrosion current densities for both samples (B-T-AAO and B-O-T-AAO) were increased compared to the intact AAO layers (T-AAO and O-T-AAO), suggesting that some portion of the aluminum surface was exposed to the corrosive media due to the cracks. However, it should be noted that the corrosion current density of the B-O-T-AAO surface was increased only by a factor of 4 (from $6.25\times10^{-9}$ to $2.88\times10^{-8}$ A $cm^{-2}$), whereas the corrosion current density of the B-T-AAO surface increased by more than 30 times (from $2.21\times10^{-8}$ to $6.68\times10^{-7}$ A $cm^{-2}$). In addition, due to the presence of cracks in AAO, the IE value of T-AAO decreased by 0.39%, while the decrease is much less (only by 0.01%) for O-T-AAO. The reason for such a dramatic difference between B-O-T-AAO and B-T-AAO is mainly because the oil impregnated in the B-O-T-AAO can flow towards the damaged region and cover the exposed area to protect against the corrosive media. Moreover, the current density of the B-T-AAO increased more rapidly in the anodic potential region and finally was comparably close to that of Al, showing the vulnerability of the T-AAO surface against surface damage. Although the corrosion current density of the B-O-T-AAO was slightly higher than that of T-AAO, the current density at the anodic potential region is still significantly lower (see FIG. 5D). It should also be noted that the slope of the anodic branch of the B-O-T-AAO is higher that of T-AAO (see inserted plot in FIG. 5D), indicating a smaller increment of corrosion rate with respect to the rise of corrosion potential. The results also show that the corrosion resistance of B-O-T-AAO (i.e., with cracks) is still comparable or even superior to that of the intact T-AAO (i.e., without any cracks), owing to the self-healing property.

To visually demonstrate the advantage of the self-healing property for anti-corrosion, a highly corrosive liquid (35 wt. % HCl+saturated $CuSO_4$) was placed on the B-O-T-AAO and B-T-AAO surfaces, respectively, which contain many defects and cracks. Appearances of the corrosive liquid droplet on the surfaces over time are shown in FIGS. 6-8. For the B-O-T-AAO surfaces, O-T-AAOs prepared by a simple dip coating as wells by the solvent exchange method for the oil impregnation were tested to verify the significance of the complete impregnation of oil into the high-aspect-ratio dead-end nanopores for the superior self-healing property. Prior to bending the O-T-AAOs for crack, a shear flow of water was applied for 5 min on both surfaces. The corrosive liquid droplet on the B-T-AAO surface (FIG. 6) rapidly spread out due to the significant evolution of gas caused by the dissolution of aluminum, indicating a high corrosion rate of the B-T-AAO. The B-O-T-AAO prepared with a conventional dip coating method for the oil impregnation also shows the significant evolution of gas with enlarging droplet (FIG. 7). In contrast, the corrosive liquid droplet on the B-O-T-AAO prepared with the solvent exchange method (FIG. 8) slowly slid along the surface, and there was no gas evolution and noticeable change to the corrosive liquid droplet, indicating a significantly impeded corrosion. The corrosive liquid droplet left a mark of corrosion for all surfaces. However, the mark on B-O-T-AAO prepared with the solvent exchange method was significantly smaller than that on the B-T-AAO as well as the B-O-T-AAO prepared with a conventional dip coating method.

Figure 9:
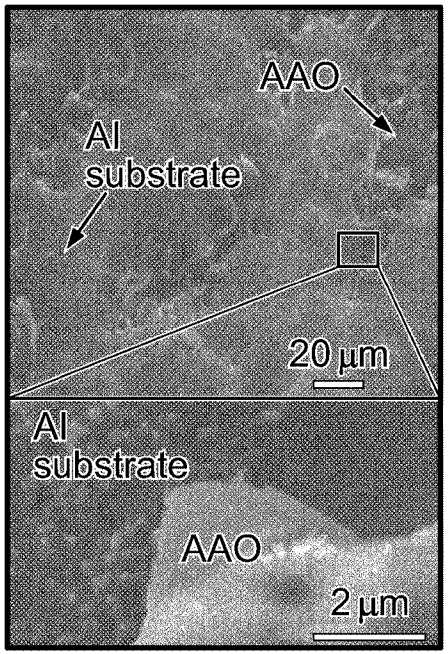
FIGS. 9-11 illustrate close-up SEM images of the corrosion marks (the respective circular areas marked in FIGS. 6F, 7F, and 8F on the B-T-AAO and B-O-T-AAO surfaces).
Figure 10:
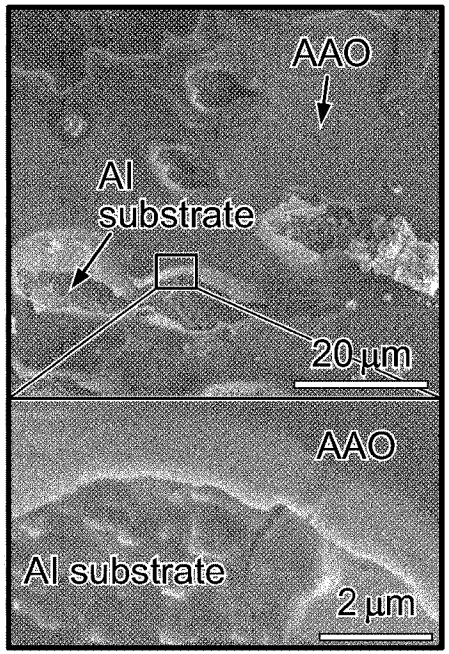
Figure 11:
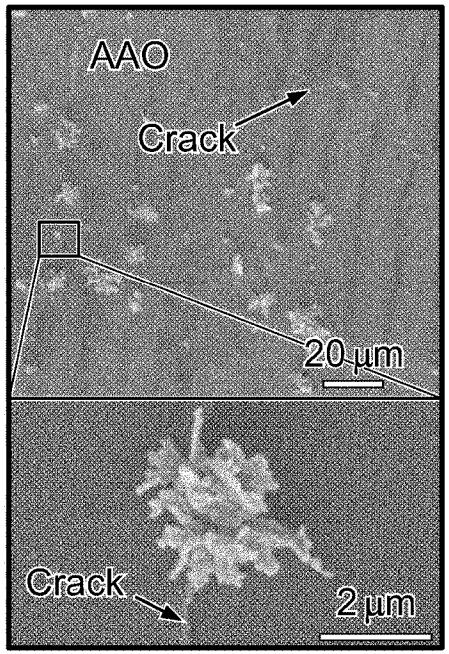
Figure 12:
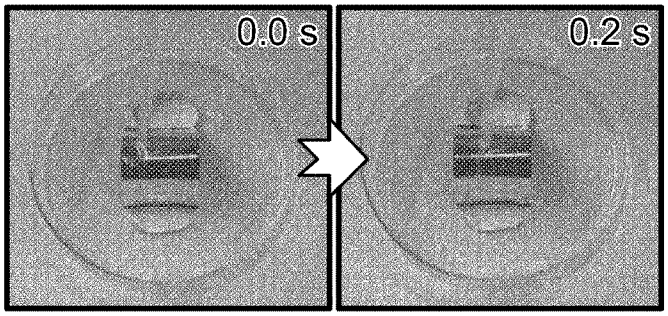
FIGS. 12 and 13 illustrate sequential images of a water droplet on B-O-T-AAO and its surface flattened back, respectively.
Figure 13:
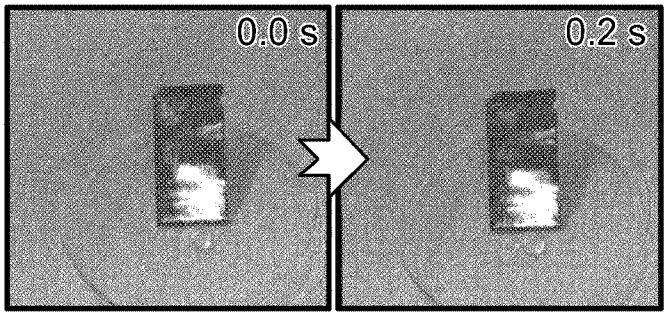

Microstructures of the surface area of each corrosion mark are shown for B-T-AAO and B-O-T-AAOs in FIGS. 9, 10, and 11, respectively. In the case of the B-T-AAO (FIG. 9) and the B-O-T-AAO prepared with a conventional dip coating for the oil impregnation (FIG. 10), most of the AAO layer has been removed by severe corrosion, thus the initial cracks in the AAO were not observable. In addition, the dissolved aluminum surface without an AAO layer was revealed to the outside. In contrast, the microstructures of the B-O-T-AAO layer prepared with the solvent exchange method for the oil impregnation were not significantly damaged by the corrosive liquid droplet so that any aluminum substrate underneath of the AAO layer was not revealed. Only the copper residues formed by the displacement reaction with dissolved aluminum were found on some cracks (FIG. 11), indicating that the corrosive media could not spread along the cracks. The results indicate that O-T-AAO realized with the solvent exchange method for the oil impregnation has an enhanced corrosion tolerance to physical damage and defects on the surface in such a way that the oil impregnated in the pores can wick into the cracked region and fill the cracks. Hence, the oil automatically reflows and covers the exposed metallic aluminum surface, insulating aluminum from the external corrosive environment. Moreover, since the oil covers the damaged areas in the O-T-AAO surface, the irregular cracks are inhibited from becoming pinning sites for a water droplet so that the surface is still slippery (FIGS. 12 and 13).

Supplemental details and further experimental verification are presented in the publication by Lee, J et al. entitled "Oil-Impregnated Nanoporous Oxide Layer for Corrosion Protection with Self-Healing," *Advanced Functional Materials*, Vol 27, Apr. 18, 2017, Article No. 1606040 [online], <URL:https://onlinelibrary.wiley.com/doi/abs/10.1002/adfm.201606040> <DOI:10.1002/adfm.201606040>, the entire contents of which publication are incorporated herein by reference.

It will be understood that the embodiments described herein are merely exemplary and that a person skilled in the art may make many variations and modifications without departing from the spirit and scope of the invention. All such variations and modifications are intended to be included within the scope of the invention.

We claim:

1. A method of forming a hydrophobic coating on a surface of an aluminum substrate, said method comprising the steps of:

anodizing said substrate in an acid selected so as to form an oxide layer which includes a plurality of nanopores having walls, at least some of said nanopores of said plurality of nanopores having a sidewall extending through said oxide layer to a dead end thereof, whereby said at least some of said nanopores exhibit a high aspect ratio;

coating said walls, including said sidewall of each nanopore of said at least some of said nanopores, with a hydrophobic coating material;

providing said plurality of nanopores, including said at least some of said nanopores, with a filling solution having a surface tension selected to allow said filling solution to penetrate said plurality of nanopores, including said at least some of said nanopores;

providing said plurality of nanopores, including said at least some of said nanopores, with an exchange fluid which is miscible with said filling solution and which replaces said filling solution in said plurality of nanopores, including said at least some of said nanopores; and providing said plurality of nanopores, including said at least some of said nanopores, with a liquid oil which is miscible with said exchange fluid and which replaces said exchange fluid in said plurality of nanopores, including said at least some of said nanopores, said liquid oil being provided in a quantity sufficient to completely fill said plurality of nanopores, including said at least some of said nanopores, such that said plurality of nanopores, including said at least some of said nanopores, contain said liquid oil only.

2. The method of claim 1, wherein said exchange fluid is a fluorocarbon fluid.

3. The method of claim 1, wherein said liquid oil is a perfluorinated oil.

4. The method of claim 1, wherein said filling solution has a low Henry's constant.

5. The method of claim 1, wherein said method is conducted in a liquid environment.

6. The method of claim 1, wherein said liquid oil is a perfluorinated oil, said filling solution is ethanol and said exchange fluid is a fluorocarbon fluid.

7. The method of claim 1, wherein said filling solution is ethanol.

8. The method of claim 1, wherein said acid is oxalic acid.

* * * * *